US007163406B2

(12) United States Patent
Ma

(10) Patent No.: US 7,163,406 B2
(45) Date of Patent: Jan. 16, 2007

(54) ELECTRICAL CONNECTOR ASSEMBLY

(75) Inventor: Hao-Yun Ma, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/173,368

(22) Filed: Jun. 30, 2005

(65) Prior Publication Data

US 2006/0003613 A1 Jan. 5, 2006

(30) Foreign Application Priority Data

Jul. 2, 2004 (CN) ..... 2004 2 0624717

(51) Int. Cl.
*H01R 12/00* (2006.01)

(52) U.S. Cl. ..... 439/70; 439/331

(58) Field of Classification Search ..... 439/331, 439/70, 71, 73

See application file for complete search history.

(56) References Cited

U.S. PATENT DOCUMENTS 4,630,875 A * 12/1986 Korsunsky et al. ..... 439/73
4,846,703 A * 7/1989 Matsuoka et al. ..... 439/71
4,936,783 A * 6/1990 Petersen ..... 439/70
5,109,980 A * 5/1992 Matsuoka et al. ..... 206/724
5,288,238 A * 2/1994 Ikenaka et al. ..... 439/91
6,916,195 B1 * 7/2005 Byquist ..... 439/342
6,927,981 B1 * 8/2005 Kao ..... 361/740
2005/0014400 A1 * 1/2005 Liao et al. ..... 439/73
2005/0032408 A1 * 2/2005 Liao et al. ..... 439/331
2005/0042897 A1 * 2/2005 Zhang et al. ..... 439/71
2005/0106922 A1 * 5/2005 Ma ..... 439/331

* cited by examiner

*Primary Examiner*—Tulsidas C. Patel
*Assistant Examiner*—Vladimir Imas
(74) *Attorney, Agent, or Firm*—Wei Te Chung

(57) ABSTRACT

An electrical connector assembly (1) includes an insulative housing (20) receiving conductive terminals (26) therein, an integrated circuit package (30) mounted on the housing, a stiffener (40) surrounding the housing, a load plate (50) pivotally assembled with a first end (401) of the stiffener, and a load lever (60) assembled with a second end (402) of the stiffener. The housing defines at least one cut (241) in a side wall thereof, and the IC package defines at least one protrusion (302). After the IC package is mounted on the housing, the at least one protrusion is located in the at least one cut.

16 Claims, 6 Drawing Sheets

ELECTRICAL CONNECTOR ASSEMBLY

BACKGROUND OF THE INVENTION

1. Field of the Invention

The present invention relates to an electrical connector assembly, especially to a land grid array (LGA) connector assembly mounted on a printed circuit board (PCB).

2. Description of the Related Arts

Modern computer systems increase in performance and complexity at a very rapid pace, driven by intense competition and market demands. In order to meet ever-increasing performance requirements, the area and volumetric interconnect densities of electronic board assemblies must increase accordingly. In combination with other competitive forces, this demand has driven the need for improved high-density socket technologies in computer applications, and the connector industry has responded with a variety of new alternatives to meet these needs. One of the most attractive of the new connector types is the land grid array (LGA) socket connector, which permits direct electrical connection between an LGA integrated circuit and a printed circuit board. LGA socket connectors are an evolving technology in which an interconnection between mating surfaces of an IC or other area array device and a printed circuit board is provided through a conductive terminal received in the socket connector. Connection is achieved by mechanically compressing the IC onto the socket connector.

FIG. 4 shows a conventional and widely-used LGA connector assembly 7. The connector assembly 7 comprises an insulative housing 72 receiving a plurality of conductive terminals 74 therein, an LGA integrated circuit (IC) package 73 mounted on the housing 72, a stiffener 76 surrounding the housing 72, a load plate 75 pivotally assembled with a first end 761 of the stiffener 76, and a load lever 77 pivotally assembled with a second end 762 of the stiffener 76.

The insulative housing 72 defines a bottom wall 721 and two pairs of side walls 722 extending upwardly from the bottom wall 721, which forms a receiving space 723 for holding the LGA IC package 73. Two parallel side walls 722 of the insulative housing 72 defines a cut 724 in a middle portion thereof, respectively. The LGA IC package 73 is generally quadrate-configured. The LGA IC package 73 comprises an integrated heat-sink module 731 on a middle portion thereof and a peripheral portion 732 surrounding the heat-sink module 731. The load plate 75 defines an opening 751 for receiving the heat-sink module 731 of the LGA IC package 73, and a pair of pressing portions 752 for pressing on the peripheral portion 732 of the heat-sink module 73.

Referring to FIGS. 4–5, when the LGA IC package 73 is accommodated in the receiving space 723 of the insulative housing 72, the LGA IC package 73 is restricted by the bottom wall 721 and the side walls 722. When the connector assembly 7 is closed, as shown in FIG. 6, the pressing portions 752 press on the peripheral portion 732 of the LGA IC package 73, and the heat-sink module 731 is exposed outside via the opening 751. The two cuts 724 are served as removing space for a user to remove the IC package 73 from the housing 72 by holding two sides of the IC package 73 with fingers placed in the cuts 724.

However, the two sides held by the fingers are so close to the terminals 74 received in the housing 72 that it is easy to damage the terminals 74 with unmerited operation, which is a disadvantage of the conventional connector assembly.

In view of the above, what is needed is an electrical connector assembly which is convenient for a user to remove an IC package therefrom and is effectual to avoid damaging the terminals therein.

SUMMARY OF THE INVENTION

According to the present invention, an improved electrical connector assembly is provided to resolve the disadvantage described above. The electrical connector comprises an insulative housing receiving a plurality of conductive terminals therein, an IC package mounted on the housing, a stiffener surrounding the housing, a load plate pivotally assembled with a first end of the stiffener, and a load lever assembled with a second end of the stiffener. The housing defines at least one cut in a side wall thereof, and the IC package defines at least one protrusion. After the IC package is mounted on the housing, the at least one protrusion is located in the at least one cut. The protrusion is far away from the terminals. As the protrusion is far away from the terminals, it is convenient and safe for a user to operate without damaging the terminals.

Other advantages and novel features of the present invention will become more apparent from the following detailed description when taken in conjunction with the accompanying drawings, in which:

DESCRIPTION OF PREFERRED EMBODIMENT

Reference will now be made to the drawings to describe the present invention in detail.

Figure 1:
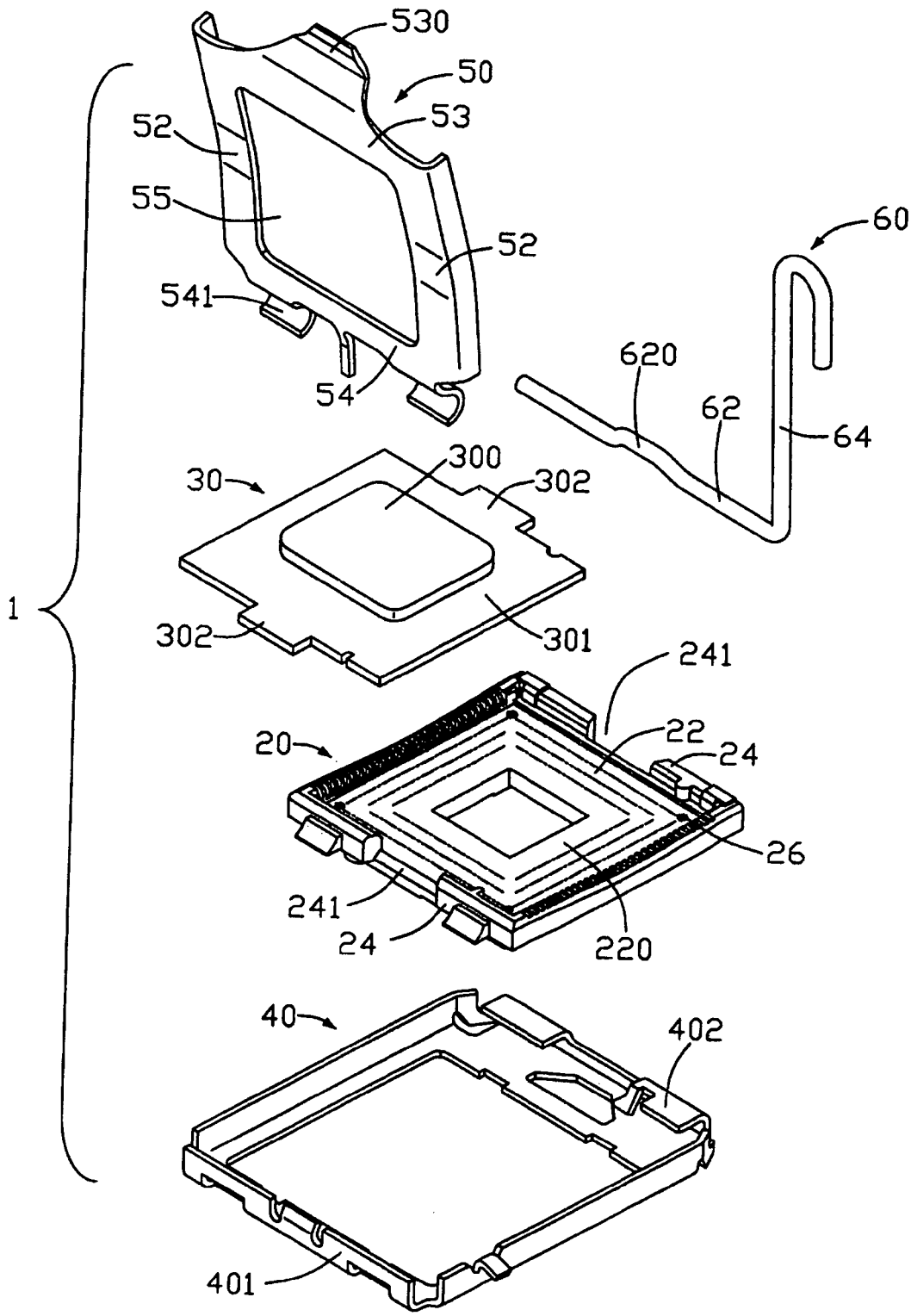
FIG. 1 is an exploded isometric view of an electrical connector assembly in accordance with a preferred embodiment of the present invention.
Figure 2:
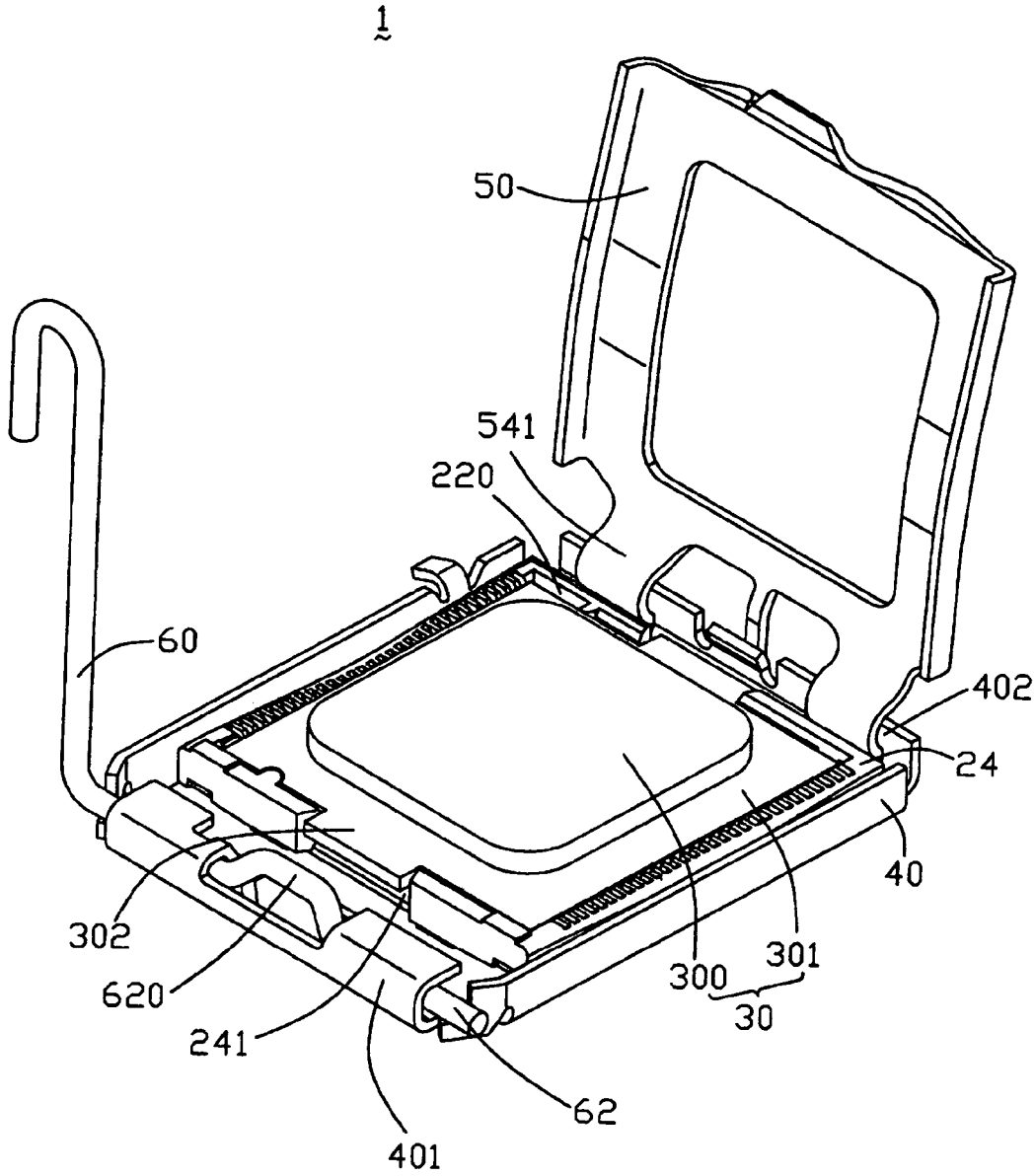
FIG. 2 is an assembled view of FIG. 1, wherein the electrical connector assembly is open.
Figure 3:
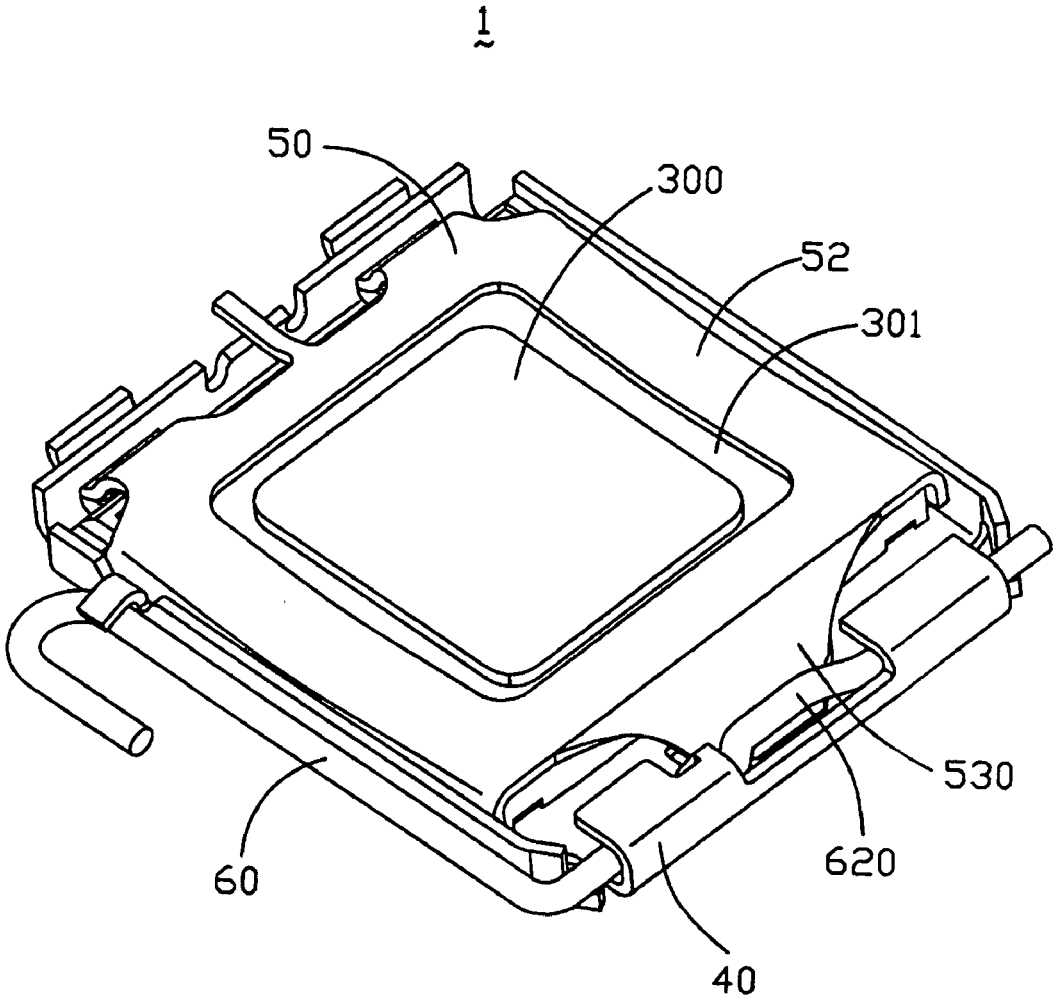
FIG. 3 is an assembled view of FIG. 1, wherein the electrical connector assembly is closed.
Figure 4:
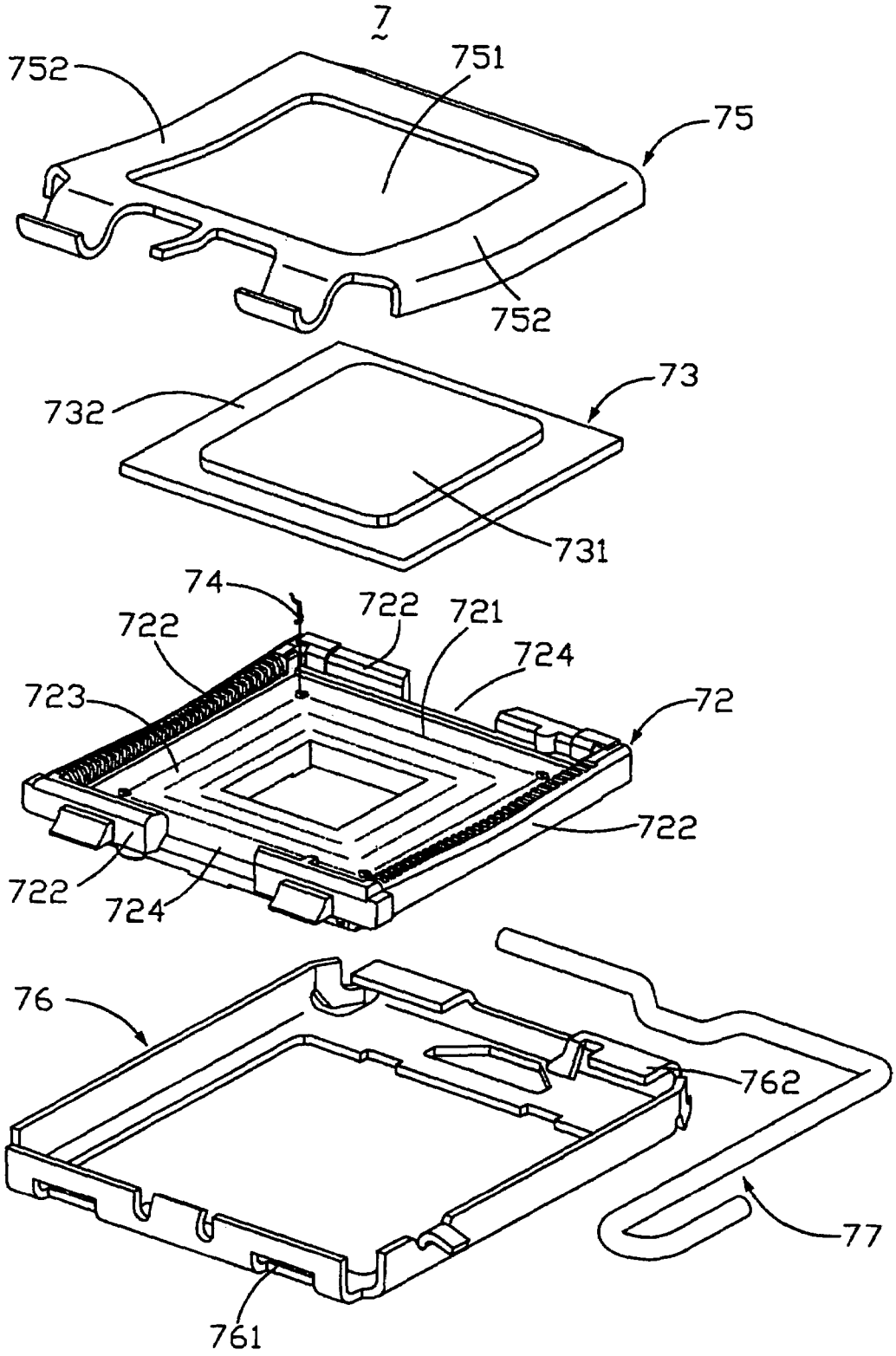
FIG. 4 (PRIOR ART)
FIG. 4 is an exploded isometric view of a conventional electrical connector assembly.
Figure 5:
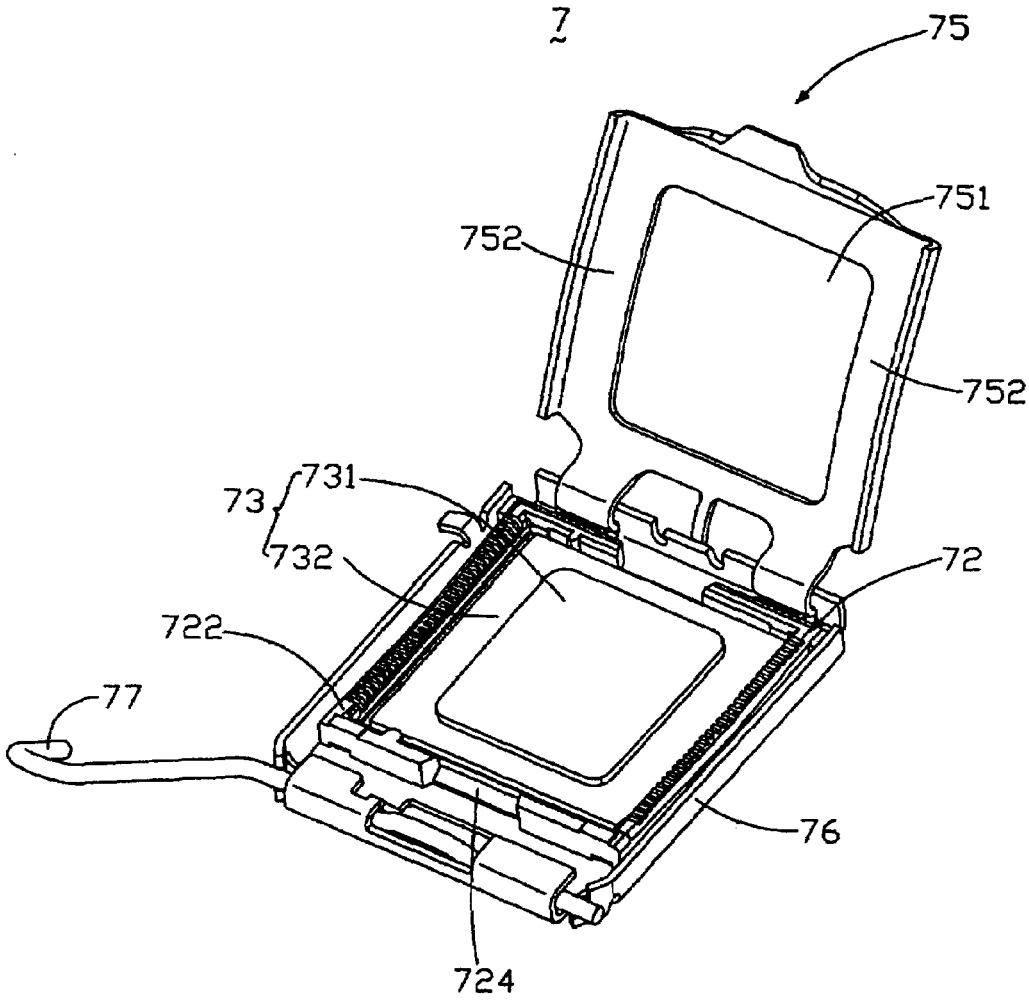
FIG. 5 (PRIOR ART)
FIG. 5 is an assembled view of FIG. 4, wherein the electrical connector assembly is open.
Figure 6:
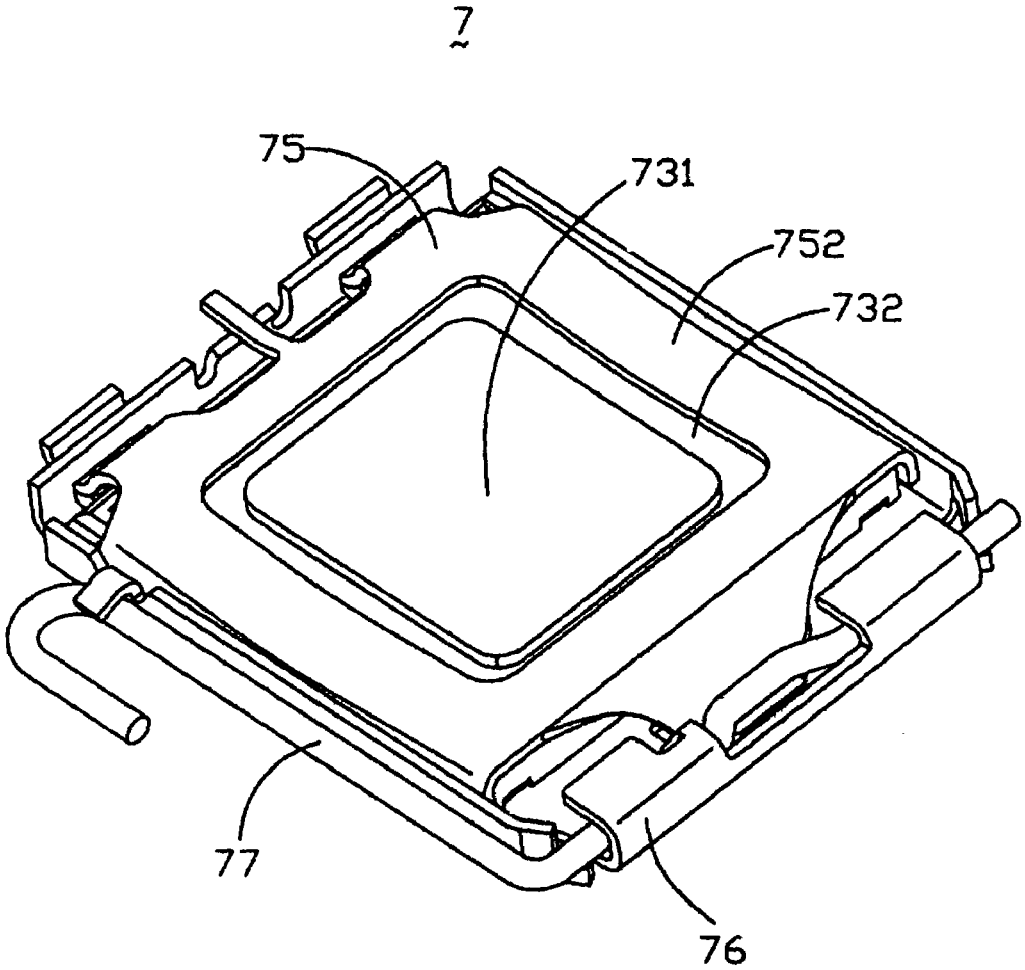
FIG. 6 (PRIOR ART)
FIG. 6 is an assembled view of FIG. 4, wherein the electrical connector assembly is closed.

FIGS. 1–3 disclose an electrical connector assembly 1 in accordance with a preferred embodiment of the present invention. Referring to FIG. 1, the electrical connector assembly 1 comprises an insulative housing 20, an integrated circuit package 30 mounted on the housing 20, a stiffener 40 surrounding the housing 20, a load plate 50, and a load lever 60.

The insulative housing 20 defines a bottom wall 22 and two pairs of side walls 24 extending upwardly from the bottom wall 22, which forms a receiving zone 220 for receiving the integrated circuit package 30. A plurality of conductive terminals 26 is accommodated in the bottom wall 22 in a predetermined array. At least two opposed side walls 24 defines a cut 241, respectively.

The integrated circuit package 30 is generally quadrate-configured and defines a integrated heat-sink module 300 in a middle portion thereof and a peripheral portion 301 surrounding the heat-sink module 300. At least two opposed protrusions 302 extend from the peripheral portion 301.

The stiffener 40 defines a first end 401 and a second end 402 opposed to the first end 401.

The load plate 50 defines a pair of pressing portions 52, a front beam 53 connecting distal ends of the two pressing portions 52, and a rear beam 54 connecting the other distal ends of the two pressing portions 52, which forms an opening 55 in a middle portion of the load plate 52. The front beam 53 defines a tongue 530 extending far away from the rear beam 54, and the rear beam 54 defines a pair of pivotal portions 541 extending far away from the front beam 53.

The load lever 60 comprises a pivotal lever 62 and an actuating lever 64 extending substantially perpendicular to the pivotal lever 62. The pivotal lever 62 defines a pressing section 620.

Referring to FIGS. 2–3, which are assembled views of the electrical connector assembly, the integrated circuit package 30 is restricted in the receiving zone 220 by the side walls 24, with the protrusions 302 being located in the cuts 241 of the housing 20. The load plate 50 is assembled with the stiffener 40 by the cooperation between the first end 401 and the pivotal portions 541, which enables the load plate 50 to rotate about the first end 401 between an open position and a closed position. The load lever 60 is assembled with the stiffener 40 by the cooperation between the pivotal lever 62 and the second end 402 of the stiffener 40, which enables the load lever 60 to rotate between an open position and a closed position. When the connector assembly is closed, as shown in FIG. 3, the integrated circuit package 30 is reliably restricted in the housing 20 with the pressing portions 52 of the load plate 50 pressing on the peripheral portion 301, and the pressing section 620 pressing on the tongue 530. The heat-sink module 300 is disposed outside via the opening 55 of the load plate 50 for dissipating heat produced during working process of the integrated circuit package 30.

When it is necessary for a user to remove the integrated circuit package 30 from the housing 20, the user can seize the integrated circuit package by holding the protrusions 302 thereof. As the protrusions 30 extend into the cuts 241 of the housing 20, a distance from the most out side of the protrusion 302 to the terminal array is increased accordingly. As a result, it is not easy for the user to touch the terminals 26 during the removal process, and damage to the terminals 26 is avoided.

Furthermore, although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector assembly comprising:

an insulative housing defining a bottom wall and side walls extending from the bottom wall, a receiving zone being formed by the bottom wall and the side walls;

a plurality of conductive terminals received in the bottom wall in a predetermined array;

an integrated circuit package received in the receiving zone floatably supported by the terminals; wherein at least one of the side wall of the housing defines a cut, and the integrated circuit package defines a protrusion located in the cut.

2. The electrical connector assembly as described in claim 1, wherein the housing defines a pair of cuts in two opposed side walls thereof, and the integrated circuit package defines a pair of opposed protrusions corresponding to the cuts.

3. The electrical connector assembly as described in claim 1 further defining a stiffener surrounding the housing.

4. The electrical connector assembly as described in claim 3 further defining a load plate pivotally assembled with a first end of the stiffener, and defining a load lever pivotally assembled with a second end opposed to the first end of the stiffener.

5. An electrical connector assembly comprising:

an insulative housing defining a bottom wall and side walls extending from the bottom wall, a receiving zone being formed by the bottom wall and the side walls;

a plurality of conductive terminals received in the bottom wall;

an integrated circuit package received in the receiving zone floatably supported by the terminals; wherein the integrated circuit package partially transits at least one side wall of the housing.

6. The electrical connector assembly as described in claim 5 further defining a stiffener surrounding the housing.

7. The electrical connector assembly as described in claim 6 further defining a load plate pivotally assembled with a first end of the stiffener, and defining a load lever pivotally assembled with a second end opposed to the first end of the stiffener.

8. An electrical connector assembly, comprising:

an insulative housing defining a bottom wall and side walls extending from the bottom wall, a receiving zone being formed by the bottom wall and the side walls;

an integrated circuit package received in the receiving zone;

a plurality of conductive terminals received in the bottom wall;

at least one of the side wall of the housing is provided with a channel for receiving a protruding part of the integrated circuit package.

9. The electrical connector assembly as described in claim 8, wherein two opposed side walls are each provided with a channel for receiving two opposed parts of the integrated circuit package.

10. The electrical connector assembly as described in claim 8 further defining a stiffener surrounding the housing.

11. The electrical connector assembly as described in claim 10 further defining a load plate pivotally assembled with a first end of the stiffener, and defining a load lever pivotally assembled with a second end opposed to the first end of the stiffener.

12. The electrical connector assembly as described in claim 1, wherein the protrusion is dimensioned to be snugly received in the cut.

13. The electrical connector assembly as described in claim 5, wherein a location where transition occurs is around a middle portion of the corresponding side wall.

14. The electrical connector assembly as described in claim 8, wherein said protruding part extends through said channel in a front-to-back direction.

15. The electrical connector assembly as described in claim 1, wherein said protrusion extends along a front-to-back direction and beyond a contour defined by the remaining portions of said integrated circuit package.

16. The electrical connector assembly as described in claim 10, wherein said stiffener defines a first dimension, along a front-to-back direction, being relatively significantly larger than that of the housing along said front-to-back direction, and a second dimension, along a lateral direction perpendicular to said front-to-back direction, being relatively only little bit larger than that of the housing along said lateral direction, and said protrusion extending through the channel along said front-to-back direction.

* * * * *